US009267310B2

(12) United States Patent
Linnåsen et al.

(10) Patent No.: US 9,267,310 B2
(45) Date of Patent: Feb. 23, 2016

(54) HANDLE ASSEMBLY FOR DOUBLE-WALLED DOOR

(75) Inventors: Adam Linnåsen, Tenhult (SE); Emelie Garancz, Jköping (SE)

(73) Assignee: Industrilås I NässjöAB, Nassjo (SE)

( * ) Notice: Subject to any disclaimer, the term of this patent is extended or adjusted under 35 U.S.C. 154(b) by 233 days.

(21) Appl. No.: 13/696,737

(22) PCT Filed: Dec. 20, 2010

(86) PCT No.: PCT/SE2010/051437

§ 371 (c)(1), (2), (4) Date: Dec. 4, 2012

(87) PCT Pub. No.: WO2012/087195

PCT Pub. Date: Jun. 28, 2012

(65) Prior Publication Data

US 2013/0264833 A1 Oct. 10, 2013

(51) Int. Cl.
*E05B 3/00* (2006.01)
*E05B 1/00* (2006.01)
(Continued)

(52) U.S. Cl.
CPC . *E05B 1/003* (2013.01); *E05B 3/00* (2013.01); *E05B 3/06* (2013.01); *E05B 15/02* (2013.01);
(Continued)

(58) Field of Classification Search
CPC ..... E05B 3/003; E05B 3/00; E05B 55/005; E05B 1/0007; Y10S 292/53; Y10T 16/46
USPC ..... 292/347, 348, 349, 350, 351, 352, 353, 292/354, 355, 356, 357, 358, 336.3
See application file for complete search history.

(56) References Cited

U.S. PATENT DOCUMENTS 192,343 A * 6/1877 Niles ..... 292/169.21
197,381 A * 11/1877 Bau ..... 292/352
(Continued)

FOREIGN PATENT DOCUMENTS

DE 2116489 10/1972
DE 202007008827 10/2007
(Continued)

*Primary Examiner* — Kristina Fulton
*Assistant Examiner* — Faria Ahmad
(74) *Attorney, Agent, or Firm* — Vidas, Arrett & Steinkraus, P.A.

(57) ABSTRACT

The present disclosure relates to a handle assembly (100) for arrangement on a double-walled door (200) comprising a first door wall (220) and a second door wall (230), and a space (210) between the two door walls. The handle assembly comprises a shaft (130) having a first and a second end and arranged for extending through the two door walls (220, 230), a first handle part (110) for arrangement to the first end of the shaft (130) such that the first handle part abuts an outer side of the first door wall, and a second handle part (120) for arrangement to the second end of the shaft (130) such that the second handle part abuts an outer side of the second door wall. The handle assembly (100) further comprises a distance tube through which the shaft extends, the distance tube comprising a first tube part (150) and a second tube part (160). The first handle part (110), when arranged to the shaft (130), contacts the first tube part (150) such that the first tube part is pressed towards an inner side (231) of the second door wall (230). Further, the second handle part (120), when arranged to the shaft (130), contacts the second tube part (160) such that the second tube part is pressed towards an inner side (221) of the first door wall (220).

20 Claims, 6 Drawing Sheets

(51) Int. Cl.

| | |
|---|---|
| ***E05B 15/02*** | (2006.01) |
| ***E05B 3/06*** | (2006.01) |
| ***E05B 65/02*** | (2006.01) |
| *E05B 63/06* | (2006.01) |
| *E05C 3/04* | (2006.01) |

(52) U.S. Cl.

CPC ..... *E05B 65/02* (2013.01); *E05B 63/06* (2013.01); *E05C 3/04* (2013.01); *Y10T 29/49826* (2015.01); *Y10T 292/57* (2015.04)

(56) References Cited

U.S. PATENT DOCUMENTS

| | | | | | |
|---|---|---|---|---|---|
| 231,223 | A | * | 8/1880 | Harris | 292/355 |
| 242,922 | A | * | 6/1881 | Good | 292/355 |
| 281,701 | A | * | 7/1883 | Kirby | 292/348 |
| 289,305 | A | * | 11/1883 | Phipps | 292/355 |
| 290,247 | A | * | 12/1883 | Lattimer | 292/348 |
| 297,402 | A | * | 4/1884 | Howland | 292/337 |
| 323,063 | A | * | 7/1885 | Niles | 292/165 |
| 467,281 | A | * | 1/1892 | Napier | 292/348 |
| 473,262 | A | * | 4/1892 | Marhsall | 292/354 |
| 499,900 | A | * | 6/1893 | Wardwell | 292/348 |
| 520,508 | A | * | 5/1894 | Wardwell | 292/351 |
| 524,848 | A | * | 8/1894 | Doebler | 292/355 |
| 542,048 | A | * | 7/1895 | Giese | 292/348 |
| 578,381 | A | * | 3/1897 | Winchester | 292/348 |
| 612,730 | A | * | 10/1898 | Hughes | 292/353 |
| 654,102 | A | * | 7/1900 | McHardy | 292/355 |
| 671,943 | A | * | 4/1901 | Smith | 292/353 |
| 734,117 | A | * | 7/1903 | Caley | 292/358 |
| 812,904 | A | * | 2/1906 | Voight | 292/337 |
| 1,466,369 | A | * | 8/1923 | Montgomery | 292/356 |
| 2,307,110 | A | * | 1/1943 | Chesler | 292/169.18 |
| 2,357,102 | A | * | 8/1944 | Gold | 292/356 |
| 2,593,264 | A | * | 4/1952 | Cerf, Jr. | 292/352 |
| 2,669,474 | A | * | 2/1954 | Kanell | 292/169.17 |
| 2,726,891 | A | * | 12/1955 | Gresham et al. | 292/337 |
| 2,739,472 | A | * | 3/1956 | North et al. | 70/476 |
| 2,741,502 | A | * | 4/1956 | Crandell | 292/169.23 |
| 2,795,948 | A | * | 6/1957 | Rayburn | 292/169.18 |
| 2,814,194 | A | * | 11/1957 | North et al. | 70/476 |
| 2,872,236 | A | * | 2/1959 | Check | 292/336.3 |
| 2,929,649 | A | * | 3/1960 | Coe | 292/169.22 |
| 3,026,136 | A | * | 3/1962 | Russell et al. | 292/336.3 |
| 3,097,872 | A | * | 7/1963 | Russell | 292/169.17 |
| 3,123,995 | A | * | 3/1964 | Russell et al. | 70/477 |
| 3,127,208 | A | * | 3/1964 | Russell | 292/336.3 |
| 3,128,115 | A | * | 4/1964 | Patriquin et al. | 292/336.3 |
| 3,210,976 | A | * | 10/1965 | Best | 70/451 |
| 3,249,380 | A | * | 5/1966 | Ross | 292/166 |
| 3,580,622 | A | * | 5/1971 | Morgan | 292/169 |
| 3,602,539 | A | * | 8/1971 | James | 292/353 |
| 3,954,292 | A | * | 5/1976 | Johnson | 292/169.17 |
| 3,955,387 | A | * | 5/1976 | Best et al. | 70/224 |
| 4,012,929 | A | * | 3/1977 | Solovieff | 70/134 |
| 4,470,278 | A | * | 9/1984 | Hale et al. | 70/134 |
| 4,471,984 | A | * | 9/1984 | Bellantuono | 292/350 |
| 4,502,720 | A | * | 3/1985 | Fayerman et al. | 292/348 |
| 4,569,547 | A | * | 2/1986 | Fayerman et al. | 292/347 |
| 4,597,600 | A | * | 7/1986 | Wilke et al. | 292/336.3 |
| 4,728,133 | A | * | 3/1988 | Valley | 292/336.3 |
| 4,920,773 | A | * | 5/1990 | Surko, Jr. | 70/224 |
| 4,921,289 | A | * | 5/1990 | Shen | 292/336.3 |
| 5,149,155 | A | * | 9/1992 | Caeti et al. | 292/336.3 |
| 5,284,372 | A | * | 2/1994 | Lin | 292/336.3 |
| 5,364,139 | A | * | 11/1994 | Bergen et al. | 292/169 |
| 5,590,555 | A | * | 1/1997 | Kester et al. | 70/224 |
| 5,598,726 | A | * | 2/1997 | Cordle | 70/224 |
| 5,636,882 | A | * | 6/1997 | Hook | 292/359 |
| 5,761,936 | A | * | 6/1998 | Katayama | 70/224 |
| 5,816,086 | A | * | 10/1998 | Russell, IV | 70/422 |
| 5,845,522 | A | * | 12/1998 | Shen | 70/224 |
| 5,887,465 | A | * | 3/1999 | Shen | 70/224 |
| 6,038,894 | A | * | 3/2000 | Hu | 70/224 |
| 6,279,360 | B1 | * | 8/2001 | Shen | E05B 3/00 292/336.3 |
| 6,322,113 | B1 | * | 11/2001 | Ayers et al. | 292/336.3 |
| 6,351,976 | B1 | * | 3/2002 | Chen | 70/224 |
| 6,357,270 | B1 | * | 3/2002 | Vazquez | 70/472 |
| 6,523,375 | B2 | * | 2/2003 | Beatty | 70/134 |
| 6,578,884 | B2 | * | 6/2003 | Chiang | 292/66 |
| 6,598,440 | B1 | * | 7/2003 | Armstrong | 70/472 |
| 6,644,077 | B1 | * | 11/2003 | Huang | 70/468 |
| 6,681,605 | B1 | * | 1/2004 | Huang | 70/224 |
| 6,802,546 | B2 | * | 10/2004 | Bates et al. | 292/358 |
| 6,880,872 | B2 | * | 4/2005 | Eller et al. | 292/357 |
| 6,908,126 | B2 | * | 6/2005 | Senger | 292/348 |
| 6,916,053 | B2 | * | 7/2005 | Lin | 292/336.3 |
| 6,979,029 | B2 | * | 12/2005 | Shen | 292/336.3 |
| 7,066,507 | B2 | * | 6/2006 | Don | 292/336.3 |
| 7,082,794 | B2 | * | 8/2006 | Shen et al. | 70/224 |
| 7,178,373 | B2 | * | 2/2007 | Shen et al. | 70/224 |
| 7,284,775 | B2 | * | 10/2007 | Bajaj | 292/336.3 |
| 7,819,443 | B2 | * | 10/2010 | Ryan | 292/336.3 |
| 7,918,113 | B2 | * | 4/2011 | Liu et al. | 70/224 |
| 8,047,586 | B2 | * | 11/2011 | Pilotelli | 292/357 |
| 8,070,194 | B2 | * | 12/2011 | Houis | 292/347 |
| 8,087,272 | B1 | * | 1/2012 | Korban | 70/224 |
| 8,113,021 | B2 | * | 2/2012 | Tsai | 70/224 |
| 8,182,005 | B2 | * | 5/2012 | Liu et al. | 292/347 |
| 8,182,006 | B2 | * | 5/2012 | Liu et al. | 292/347 |
| 8,360,489 | B2 | * | 1/2013 | Cho | 292/357 |
| 8,419,081 | B2 | * | 4/2013 | Zhang | 292/92 |
| 8,449,003 | B2 | * | 5/2013 | Bunker et al. | 292/336.3 |
| 8,449,004 | B1 | * | 5/2013 | Wang | 292/336.3 |
| 8,449,005 | B1 | * | 5/2013 | Wang | 292/336.3 |
| 8,469,414 | B2 | * | 6/2013 | Constantinou | 292/347 |
| 8,491,023 | B2 | * | 7/2013 | Brannaman et al. | 292/347 |
| 8,534,723 | B2 | * | 9/2013 | Berger | 292/347 |
| 8,544,903 | B1 | * | 10/2013 | Shamp et al. | 292/336.3 |
| 8,590,949 | B2 | * | 11/2013 | Wang | 292/336.3 |
| 8,720,960 | B2 | * | 5/2014 | Nadgouda et al. | 292/347 |
| 2002/0117867 | A1 | * | 8/2002 | Bates et al. | 292/348 |
| 2003/0155781 | A1 | * | 8/2003 | Bui et al. | 292/357 |
| 2004/0070219 | A1 | * | 4/2004 | Senger | 292/348 |
| 2004/0189022 | A1 | * | 9/2004 | Don | 292/356 |
| 2005/0023846 | A1 | * | 2/2005 | Eller et al. | 292/357 |
| 2005/0218665 | A1 | * | 10/2005 | Shen | 292/336.3 |
| 2006/0038419 | A1 | * | 2/2006 | Lee | 292/357 |
| 2006/0208507 | A1 | * | 9/2006 | Huang et al. | 292/336.3 |
| 2006/0220396 | A1 | * | 10/2006 | Ellis | 292/336.3 |
| 2006/0284429 | A1 | * | 12/2006 | Ebert | 292/336.3 |
| 2007/0096479 | A1 | * | 5/2007 | Lin et al. | 292/336.3 |
| 2007/0176437 | A1 | * | 8/2007 | Marschalek et al. | 292/347 |
| 2007/0182169 | A1 | * | 8/2007 | Fang et al. | 292/347 |
| 2008/0252086 | A1 | * | 10/2008 | Houis | 292/348 |
| 2009/0091142 | A1 | * | 4/2009 | Wilson | 292/137 |
| 2009/0127874 | A1 | * | 5/2009 | Ryan | 292/336.3 |
| 2010/0013248 | A1 | * | 1/2010 | Keller | 292/347 |
| 2010/0187839 | A1 | * | 7/2010 | Barlett | 292/348 |
| 2013/0229021 | A1 | * | 9/2013 | Wang | 292/336.3 |
| 2013/0264833 | A1 | * | 10/2013 | Linnasen et al. | 292/336.3 |
| 2015/0091312 | A1 | * | 4/2015 | Header | 292/336.3 |

FOREIGN PATENT DOCUMENTS

| | | |
|---|---|---|
| EP | 2017414 | 1/2009 |
| JP | 9317266 | 12/1997 |

* cited by examiner

HANDLE ASSEMBLY FOR DOUBLE-WALLED DOOR

CROSS-REFERENCE TO RELATED APPLICATIONS

This application is a U.S. National Stage Application which claims priority to PCT/SE2010/051437, filed Dec. 20, 2010.

STATEMENT REGARDING FEDERALLY SPONSORED RESEARCH

Not applicable

TECHNICAL FIELD

The present disclosure relates to a handle assembly, and especially to a handle assembly for arrangement on a door comprising two walls with a distance between each other.

BACKGROUND

Handle assemblies that may be arranged on a double-walled door, for instance used in air conditioning, ventilation, refrigeration or cabinet applications, comprising two walls arranged with a distance between each other, forming a door inner space between the walls, are known. Such assemblies may comprise a first handle part and a second handle part arranged on respective sides of the door. The two handle parts are connected via a shaft extending through the door, through the inner space between the two door walls. To firmly attach each of the handle parts to the shaft and to the door, the handle parts will be pressed against the two door walls respectively with a considerable amount of force. Since the space between the two door walls may be empty, or filled with any porous material, the door may be deformed by the two door walls being pressed towards each other when the handle assembly is attached to the door.

A known way of solving the above problem is to arrange a distance tube between the two door walls such that the distance tube abuts the inner sides of both door walls. The shaft extending through the door extends through the distance tube. When the handle parts are attached to the shaft and pressed against the door walls, the distance tube will keep the door walls from being pressed towards each other, thereby avoiding that the door is deformed. However, the length of the distance tube must in such solution exactly correspond to the distance between the door walls in order to prevent the door walls from being pressed towards each other. If the distance tube is slightly too long or too short the door will be deformed. Further, since the cross-section of the distance tube must be larger than an opening in the door walls through which opening the shaft extends, the distance tube must be inserted between the door walls before the door is assembled. When a handle is to be arranged on a preassembled door, it is not possible to insert the distance tube between the door walls.

Consequently, there is a need for a handle assembly for a double-walled door that prevents the door walls from being pressed towards each other. Further, there is a need for a handle assembly that is flexible for the distance between the door walls. Further, there is a need for such a handle assembly that may be arranged on a preassembled door.

SUMMARY

It is an object of the present invention to provide an improved solution that alleviates the mentioned drawbacks with present devices. Furthermore, it is an object to provide a handle assembly for a double-walled door that prevents the door from being deformed when the handle assembly is arranged on the door.

According to a first aspect of the invention, this is achieved by providing a handle assembly for arrangement on a double-walled door comprising a first door wall and a second door wall, and a space between the two door walls. The handle assembly comprises a shaft having a first and a second end and arranged for extending through the two door walls, a first handle part for arrangement to the first end of the shaft such that the first handle part abuts an outer side of the first door wall, and a second handle part for arrangement to the second end of the shaft such that the second handle part abuts an outer side of the second door wall. The handle assembly further comprises a distance tube through which the shaft extends, the distance tube comprising a first tube part and a second tube part. The first handle part, when arranged to the shaft such that the first handle part abuts an outer side of the first door wall, contacts the first tube part such that the first tube part is pressed towards an inner side of the second door wall. Further, the second handle part, when arranged to the shaft such that the second handle part abuts an outer side of the second door wall, contacts the second tube part such that the second tube part is pressed towards an inner side of the first door wall.

By arranging such handle assembly on a double-walled door, the handle assembly may be firmly arranged on the door without the risk of deforming the door. On each side of each door wall there may be parts that presses on respective door wall. The tube parts may avoid that the handle parts press the door walls toward each other. The handle parts and the tube parts together form a cross-connection wherein each handle part is tightly arranged on respective door wall by clamping each door wall between a handle part and a tube part. Such assembly may also be easy to arrange to the door since there is no need for a distance part to be arranged inside the door prior to arranging the handle assembly. The distance tube in the present invention may be arranged to the door together with the rest of the handle assembly. By arranging the first handle part to a first end of the shaft, and arranging the shaft such that it extends through the two door walls, the first handle part may abut the first door wall when the handle assembly is arranged on the door. By arranging the second handle part to a second end of the shaft, and arranging the shaft such that it extends through the two door walls, the second handle part may abut the second door wall when the handle assembly is arranged on the door.

In one embodiment, the first handle part may comprise a first protruding member adapted to extend through the first door wall, wherein the first protruding member may be adapted to contact a first longitudinal end portion of the first tube part such that a second longitudinal end portion, opposite the first longitudinal end portion, of the first tube part may be pressed against the inner side of the second door wall.

Thereby, the first protruding member may press on the first tube part such that the tube parts presses on the inner sides of the door walls in a cross-connection. The first protruding member may stabilize the handle parts in their positions on the door walls. The arrangement of the handle assembly to the door may thereby be fixed when the handle parts are fixed to the shaft.

In another embodiment, the second handle part may comprise a second protruding member adapted to extend through the second door wall, wherein the second protruding member may be adapted to contact a first longitudinal end portion of the second tube part such that a second longitudinal end portion, opposite the first longitudinal end portion, of the second tube part may be pressed against the inner side of the first door wall.

Thereby, the second protruding member may press on the second tube part such that the tube parts presses on the inner sides of the door walls in a cross-connection. The second protruding member may stabilize the handle parts in their positions on the door walls. The arrangement of the handle assembly to the door may thereby be fixed when the handle parts are fixed to the shaft.

In another embodiment, the first handle part may comprise a first protruding member adapted to extend through an opening in the first door wall, and the second handle part may comprise a second protruding member adapted to extend through an opening in the second door wall, wherein each of the first and the second protruding member may be adapted to, at a base portion of each protruding member closest to respective handle part, have a cross-section of substantially the same size as the respective opening in each door wall through which each protruding part is adapted to extend, and wherein the cross-section of each protruding member may taper from said base portion towards an end portion, wherein said end portion of each protruding member may be adapted to press on the first and second tube parts respectively.

When a base portion of a protruding member on a handle part fills the entire opening in a door wall, the tube part that is being pressed towards the inner side of that door wall may not be pressed through that opening. The tube part may be forced to be pressed towards the door wall and not through the opening. Since the protruding part may taper from the base portion towards the end portion, the tube part that may be pressed towards the door wall through which the protruding member extends may be guided by the protruding member towards the inner side of the door wall. The second longitudinal end of a tube part, which may be pressed towards an inner side of a door wall, may substantially surround the protruding member at that door wall. The increasing cross-sectional area of the protruding member in a direction towards the door wall may thereby guide the second longitudinal end of the tube part towards the inner side of the door wall. When the tube part reaches the inner side of the door wall, it may be forced into contact with the inner side of the door wall by the protruding member.

In a further embodiment, the second longitudinal end of each of the tube parts may be provided with at least one slit.

By providing the second longitudinal end of each tube part with at least one slit, the second longitudinal end may be flexible in a radial direction. Thereby, when the second longitudinal end is pressed towards the inner of a door wall and guided by a protruding member, the second longitudinal end may expand in a radial direction along with the increasing cross-sectional area in the direction towards the door wall. In that way the second longitudinal end may be forced to contact the inner side of the door wall instead of extending through an opening in the door wall.

In a further embodiment, the second longitudinal end of the first tube part may be adapted to at least partly surround the second protruding member when the handle assembly is arranged on the shaft, such that the second longitudinal end of the first tube part may be adapted to radially expand along with the increasing cross-section of the second protruding member when being pressed against the inner side of the second door wall, and wherein the second longitudinal end of the second tube part may be adapted to at least partly surround the first protruding member when the handle assembly is arranged on the shaft, such that the second longitudinal end of the second tube part may be adapted to radially expand along with the increasing cross-section of the first protruding member when being pressed against the inner side of the first door wall.

By surrounding the protruding member, the shape of the second longitudinal end of a tube part may depend on the shape of the protruding member. Thereby, when the second longitudinal end is pressed towards a door wall it may be pressed further onto a protruding member in a direction such that the cross-sectional area of the protruding member may increase. The increasing cross-sectional area of the protruding member may force a radial expansion of the second longitudinal end. Since the base portion of the protruding member may fill the entire opening in the door wall, the second longitudinal end may be expanded along with the protruding member towards contact with the inner side of the door wall, separated from the opening in that door wall. By providing this function, the distance tube may have the same or smaller cross-sectional area as an opening in a door wall when the handle assembly is arranged on a door. The distance tube may be moved through the opening at first and then expand radially by means of a protruding member to be pressed against an inner side of a door wall.

In one embodiment, the cross-section of the distance tube may be adapted to be of substantially the same size as each of the openings in the first and second door walls through which openings the shaft is adapted to extend.

With a cross-sectional area of the distance tube that is of substantially the same size, or smaller, as an opening in a door wall, the distance tube may be inserted in the door, between the door walls, even on a preassembled door. The tube parts of the distance tube may expand inside the door during the arrangement of the handle assembly on the door.

In another embodiment, the first tube part and the second tube part may overlap each other and together form the substantially hollow distance tube adapted to receive said shaft adapted to extend through the distance tube.

The distance tube may guide the shaft along the shaft's extension between the handle parts. The tube parts may form the distance tube at the same time as the tube parts may be moveable relative to each other.

In one embodiment, the handle assembly may be provided with a locking means adapted to lock the shaft to at least one handle part when the at least one handle part is pressed towards a door wall.

The arranging procedure of the handle assembly to a door may thereby be facilitated. The handle part may easily be locked to the shaft.

In a further embodiment, the locking means may comprise a projection provided on the shaft and a shoulder provided on the at least one handle part adapted to integrate with said projection to lock the handle part to the shaft.

Such snap catch may facilitate the arranging of the handle assembly on the door. The handle parts and shaft may be snapped to each other such that they may be held in place on the door by each other during the arranging operation. The operator may thereby not need to hold all the parts by hand during arranging of the handle assembly.

In a further embodiment, said projection on the shaft may comprise a rubber ring mounted on the shaft.

Thereby a cost-effective solution for the locking means may be provided. The rubber ring may further be easy to arrange on the shaft.

In a yet further embodiment, said shoulder may be located on at least one of the first and the second protruding member.

The snap catch may thereby be formed by the parts that extend in the space between the door walls when the handle assembly is arranged on a door.

In another embodiment, the protruding members may be substantially tubular, and said shoulder may be located on an inner surface of at least one of the protruding members.

The shaft may extend through the tubular protruding members. The snap catch may be formed at an inner surface of the tubular protruding member, wherein the raising on the shaft may be located at a position such that it integrates with said shoulder when the shaft extends through the protruding member.

According to a second aspect of the invention, a method for assembling a handle assembly to a double-walled door is provided, wherein the door comprises a first door wall and a second door wall, and a space between the two door walls. The method comprises the steps of arranging a first handle part to a first end of a shaft, arranging a distance tube to said shaft such that the shaft extends through said distance tube, wherein the distance tube comprises a first tube part and a second tube part, arranging said shaft such that it extends through the two door walls, arranging a second handle part to a second end of the shaft, pressing the first handle part towards the first door wall such that the first tube part is pressed towards an inner side of the second door wall, and pressing the second handle part towards the second door wall such that the second tube part is pressed towards an inner side of the first door wall.

When the first tube part may be pressed against the inner side of the second door wall, and the second tube part may be pressed against the first door wall, the door walls may be prevented from being pressed towards each other. The door may thereby not be deformed when the handle assembly is arranged to the door.

In a further embodiment, the method further may comprise the steps of locking the first handle part in a position abutting the first door wall, and locking the second handle part in a position abutting the second door wall.

Thereby, the handle parts may be fixed to the door walls when the handle assembly is arranged to the door. The locking procedure of the first handle part may be provided by attaching a member to the first end of the shaft such that the first handle part may be held pressed to the first door wall. The locking procedure of the second handle part may be provided by attaching a member to the second end of the shaft such that the second handle part may be held pressed to the second door wall. Such members may be attached to the shaft by means of a screw attached to the shaft.

BRIEF DESCRIPTION OF THE DRAWINGS

The invention will in the following be described in more detail with reference to the enclosed drawings, wherein.

DESCRIPTION OF EMBODIMENTS

Figure 1A:
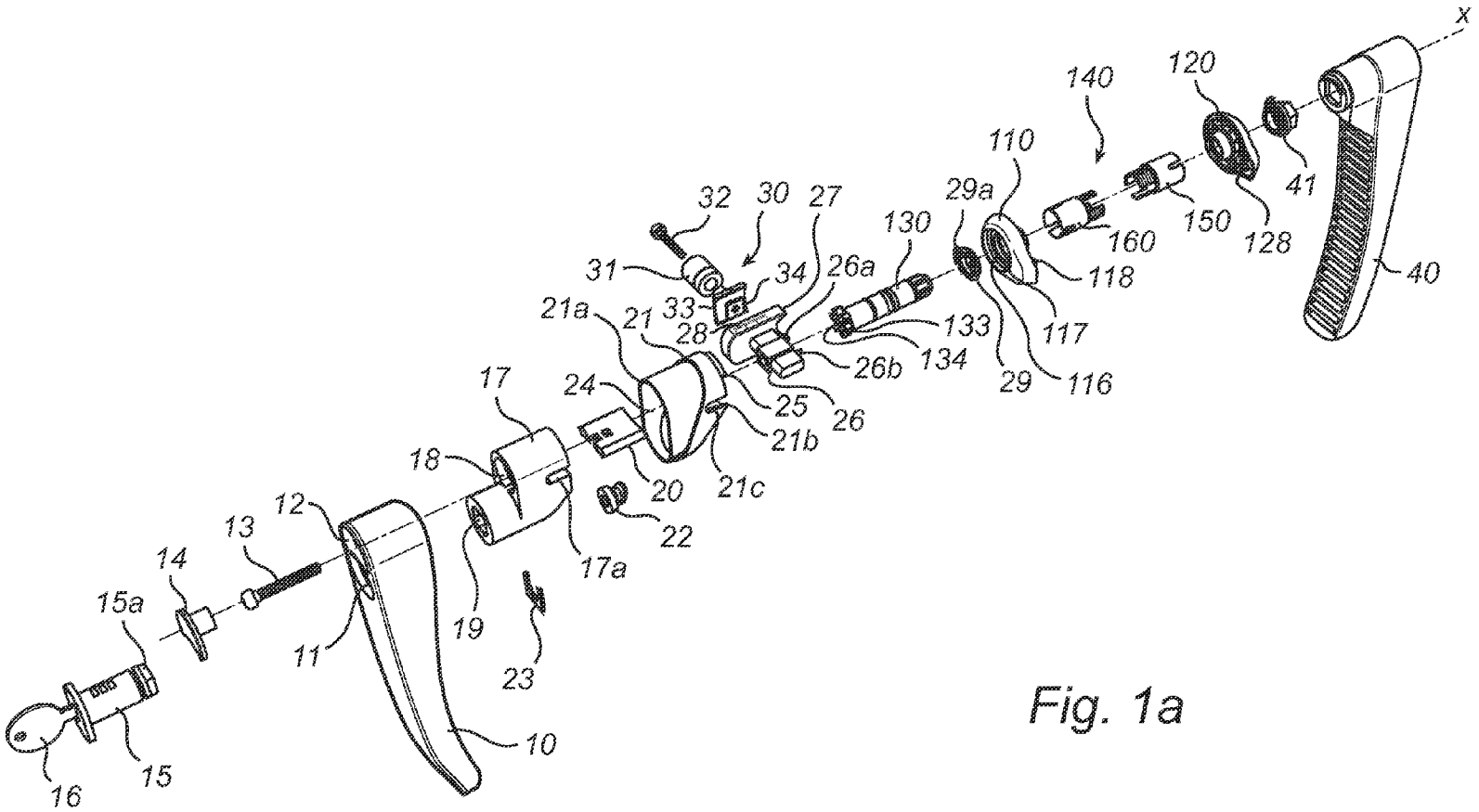
FIG. 1*a* shows an exploded perspective view of a handle and lock arrangement according to an embodiment of the invention.

The present invention will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements.

Figure 1B:
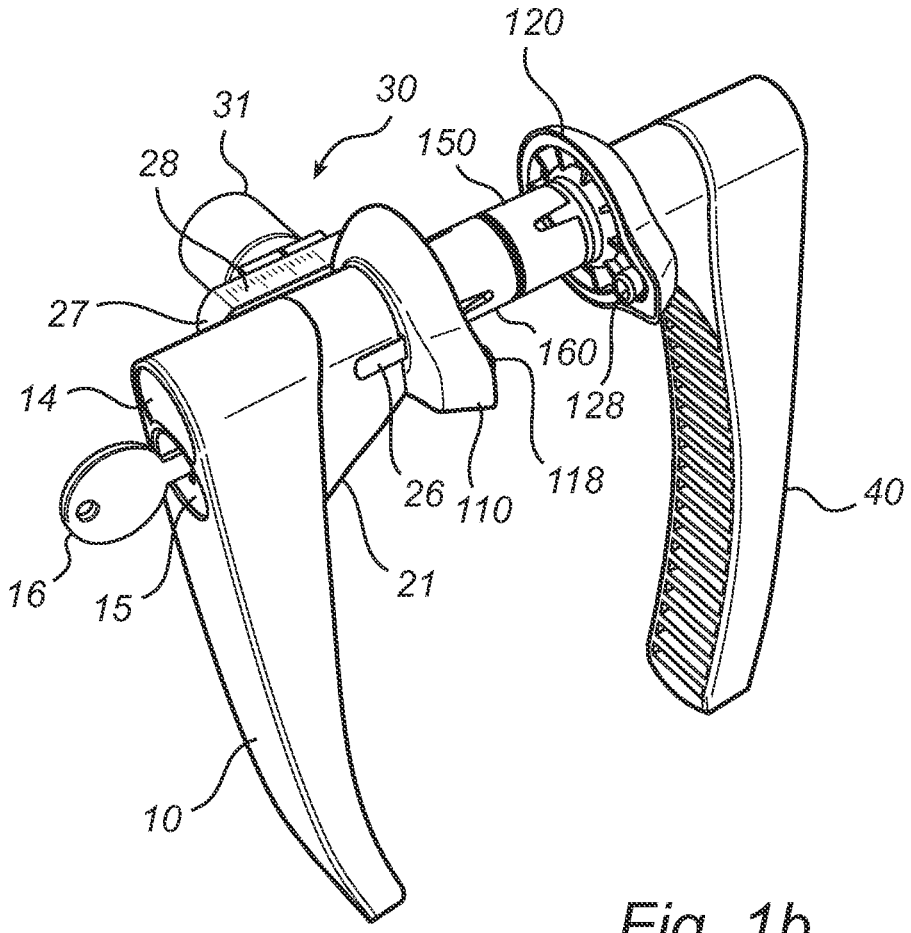
FIG. 1*b* shows a perspective view of a handle and lock arrangement according to an embodiment of the invention.

A handle and lock arrangement 1 including a handle assembly 100 according to the invention is illustrated in FIG. 1*a* and FIG. 1*b*. The handle and lock arrangement 1 comprises a first handle 10 and a second handle 40. The two handles 10, 40 are arranged to be located on each side of a door (not shown) when the handle and lock arrangement 1 including the handle assembly 100 is arranged on a door. Abutting each side of the door are a first housing 110 and a second housing 120. Each housing 110, 120 has an index pin 118, 128 each adapted to engage with a door wall when the arrangement 1 is arranged to a double-walled door, such that rotation of the housing 110, 120 relative to the door wall is prevented. The index pins 118, 128 are adapted to extend from the housings 110, 120 and engage with an opening in the respective door wall. Between the housings 110, 120, when mounted on the door, a distance tube 140 and a shaft 130 extends. These parts will be further explained in conjunction with FIG. 3-6. The shaft 130 extends through the distance tube 140. The distance tube 140 comprises a first tube part 150 and a second tube part 160, both adapted to be in contact with each of the housings 110, 120. The second handle 40 is connected to the shaft 130 and the second housing 120 via a limiter 41, limiting the rotational movement of the second handle 40.

The first handle 10 is coupled to the first housing 110. The first handle 10 is provided with a first opening 11 through which a locking cylinder 15 is received. The locking cylinder 15 controls the locking function of the handle and lock arrangement 1 by means of a key 16. In an alternative embodiment, there may be no locking function in the arrangement 1, wherein no locking cylinder is provided.

The locking cylinder 15 extends into an opening 19 in an inner part 17 of the first handle 10. The locking cylinder 15 operates a locking barrier 20 that may extend or retract along a longitudinal extension direction X of the handle and lock arrangement 1. The locking barrier 20 is operated by the locking cylinder 15 via an adapter screw 22. An end portion 15*a* of the locking cylinder 15 is adapted to integrate with a recess in the screw head of the adapter screw 22. The end portion 15*a* of the locking cylinder 15 has a square shape that gives a tight grip with the recess in the screw head of the adapter screw 22. The locking cylinder 15 and the adapted screw are thereby prevented from rotation relative to each other. When the locking cylinder 15 is put in the opening 19 in the inner part 17, a clip 23 is arranged to hold the locking cylinder 15 in a fixed position relative to the inner part 17. The clip 23 is adapted to integrate with a groove at the end portion 15*a* of the locking cylinder 15. The locking cylinder 15 is thereby locked in an axial direction along a longitudinal axis X of the handle and lock arrangement 1. When the key 16 is inserted into the locking cylinder 15, the locking cylinder 15 can be rotated such that the adapter screw 22 is rotated. If the locking cylinder 15 is rotated towards an unlocked position, the adapter screw 22 moves the locking barrier 20 along the longitudinal axis X in a direction away from the first housing 110. If the locking cylinder is rotated towards a locking position, the adapter screw 22 moves the locking barrier 20 along the longitudinal axis X in a direction towards the first housing 110. The locking function will further be explained in conjunction with FIG. 2*a-b*.

A first handle cover 21 receives the inner part 17 through a first opening 24 at a first end 21*a* of the first handle cover 21 and is arranged to the first handle 10. At a second opening 21*b* of the first handle cover 21, a protruding positioning member 25 is provided. At the second end 21*b* of the first handle cover 21, and on the inner part 17, two slits 17*a*, 21*c* are provided on each of the inner part 17 and the cover 21, one on each side of the inner part 17 and the cover 21. The slits 17*a*, 21*c* are arranged to receive a rotational connection member 26, comprising a left and right protruding cog member 26*a*, 26*b*.

To the rotational connection member 26 there is attached a roller cam adjuster 27. The roller cam adjuster 27 is provided with a scale 28. The roller cam adjuster 27 is used for holding a roller cam arrangement 30 comprising a roller cam 31, a roller cam holder 33, a nut 34 and a screw 32. The roller cam 31 is adapted to abut an inner side of a door frame (not shown) when the handle and lock arrangement 1 is in a locked position when arranged on a door. The screw 32 extends through the roller cam 31 and the roller cam holder 33, and is engaged by threads with the nut 34. The roller cam 31 is rotatable relative to the screw 32 that extends through it. The roller cam holder 33 and the nut 34 are coupled to the roller cam adjuster 27 such that roller cam arrangement 30 is slidably suspended on the roller cam adjuster 27. The slidable suspension provides that the position of the roller cam arrangement 30 relative to the rest of the handle and lock arrangement 1 is adjustable along a direction substantially in parallel with the longitudinal direction X of the handle and lock arrangement 1. Thereby, the position of the roller cam arrangement 30 may be adjusted to fit a certain application when the handle and lock arrangement 1 is arranged on a door. The properties of the door frame may differ for different doors, and the roller cam arrangement 30 may be adjusted to fit different doors. The nut 34 fits in a slot on the roller cam adjuster 27. The roller cam holder 33 is pressed towards the roller cam adjuster 27, outside the slot, when the engagement between the screw 32 and the nut 34 is tightened. To adjust the position of the roller cam arrangement 30, the screw 32 is loosened such that the roller cam holder 33 is not pressed towards the roller cam adjuster 27. Thereby, the nut 34 can be moved in the slot to a new position along the extension of the slot. The screw 32 can then be tightened to fix the roller cam arrangement 30 at the new position. The scale 28 on the roller cam adjuster 27 provides an indication of the position of the roller cam 31 along the longitudinal axis X. For adapting the position of the roller cam 31 for a certain door, the roller cam holder 33 can be placed at a certain position along the scale 28 on the roller cam adjuster 27.

Figure 2A:
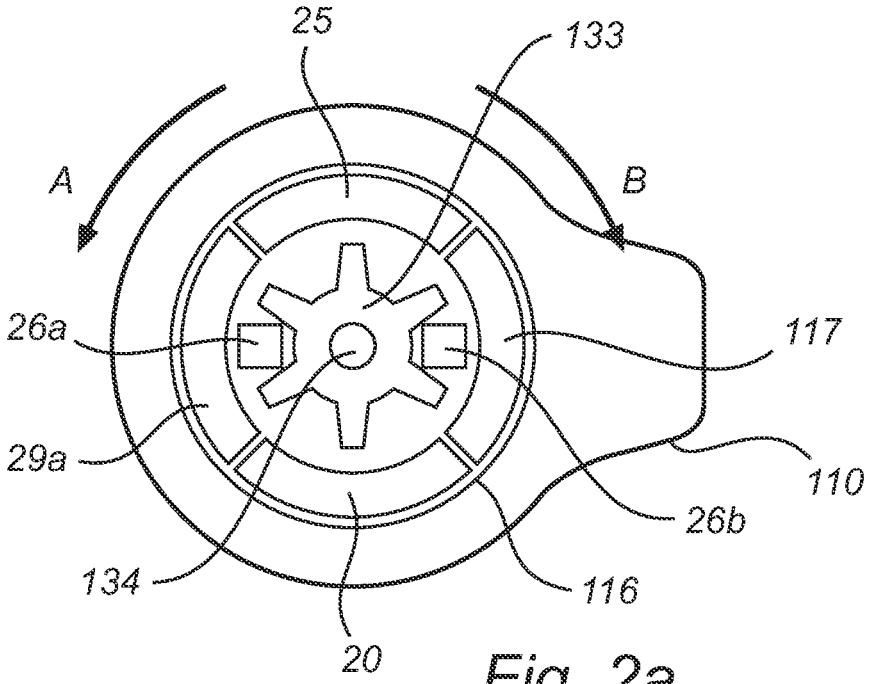
FIG. 2*a* shows a side view of a housing according to an embodiment of the invention.

The first housing 110 is provided with a recess 116. The recess 116 is adapted to receive a limiter 29, a cog head 133 provided at an end portion of the shaft 130, the left and the right protruding cog members 26*a*, 26*b*, the protruding positioning member 25 and the locking barrier 20. The cog head 133 provides a six teeth cog wheel. A cog wheel instead of a hexagon shape provides a stronger connection between the cog wheel and integrated parts. The limiter 29 is formed to integrate with the cog head 133. The limiter 29 comprises a rotational limiter part 29*a* that extends into the recess 116. Further, the left and right protruding cog members 26*a*, 26*b* and a bottom part (not shown) below the second opening 21*b* on the first handle cover 21 are adapted to integrate with the cog head 133. Referring to FIG. 2*a*, the left and right protruding cog members 26*a*, 26*b* extends into the recess 116 such that they engage with the cogs of the cog head 133 of the shaft 130. The recess 116 comprises a limiter member 117. The limiter 117 is fixedly attached to the first housing 110, in the recess 116. When the locking barrier 20 is in an extended position, i.e. a locking position, it extends into the recess 116 such that rotation of the first handle 10 to an open position, such that the door can be opened, is prevented. The rotation is prevented by the limiter member 117 which prevents the locking barrier 20 from moving along a direction A. Further, the limiter member 117 prevents the protruding positioning member 25 from moving along a direction B. The rotational limiter part 29*a* prevents the protruding positioning member 25 from moving along direction A. Movement along both direction A and direction B could have enabled a rotation to an open position of the first handle 10. But the limiter member 117 prevents such rotational movement.

Figure 2B:
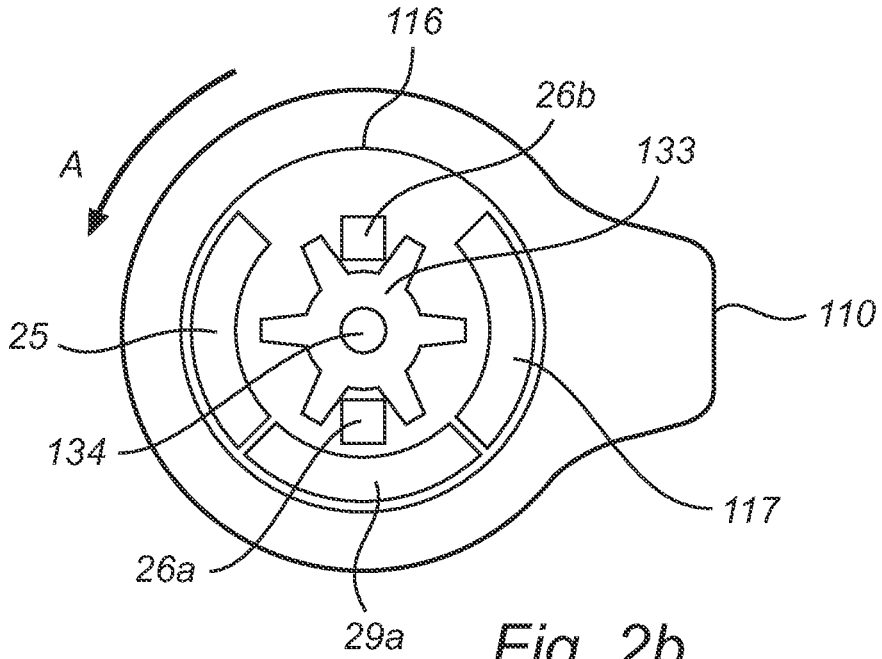
FIG. 2*b* shows a side view of a housing according to an embodiment of the invention.

When the key 16 is operated such that the locking cylinder 15 provides an axial movement of the locking barrier 20 to a retracted position, i.e. a movement towards the first handle 10, the locking barrier 20 is removed from the recess 116. The key 16 is turned approximately 90 degrees relative to the first handle 10 to retract the locking barrier 20 from the recess 116. Referring to FIG. 2*b*, when the locking barrier 20 is removed from the recess 116, a rotational movement of the first handle 10 and parts connected to it, including the first handle cover 21, the rotational connection member 26 and the roller cam arrangement 30, is enabled along the direction A. The limiter 29 presents in the recess 116 the rotational limiter part 29*a*. The rotational limiter part 29*a* is moved along the direction A together with the first handle 10, the protruding positioning member 25 and the left and right cog members 26*a*, 26*b*. When these parts are turned, the rotational limiter part 29*a* will reach the limiter 117. The limiter 117 and the rotational limiter part 29*a* then prevent the first handle 10 from being rotated more than quarter of a turn, approximately 90 degrees. When turned a quarter of a turn, the first handle 10 reaches an unlocked position. This unlocked position provides that the door to which the handle and lock arrangement 1 is arranged, can be opened. When the first handle cover 21 is turned, the left and right cog members 26*a*, 26*b* turns the cog head 133 and the shaft 130. Due to the connection to the shaft 130 also the second handle 40 is turned. Thereby, also the second handle 40 may be used for opening the door to which the handle and lock arrangement 1 is attached, as long as the arrangement 1 is unlocked.

Referring back to FIG. 1*a*, the first handle 10 is provided with a second opening 12. When assembling the handle and lock arrangement 1, a screw 13 is arranged to extend through the second opening 12 of the first handle 10, an opening 18 in the inner part 17, the first handle cover 21 and the rotational connection member 26, and to be fastened to the shaft 130. The shaft 130 is provided with inner threads 134, adapted for threaded engagement with the screw 13. The screw 13 prevents rotational movement of all parts from the locking cylinder 15 to the limiter 29 relative to each other, when fastened to the shaft 130. A cover plate 14 is provided to cover the head of the screw 13 when arranged in the second opening 12 in the first handle 10. The second handle 40 is arranged to the shaft 130 in a similar way. A screw (not shown) may fasten the second handle 40 to the shaft 130 by engaging with inner threads 135 (se FIG. 4) at an end portion of the shaft 130. A limiter 41 is provided in a recess in the second housing 120. The second handle 40 is thereby, in a similar way as the first handle 10, prevented from being turned more than a quarter of a turn relative to the second housing 120.

Due to the design of the handle and lock arrangement 1, it is arrangeable on a door both in a left hand way and a right hand way. As viewed in FIG. 1-2, the first handle 10 is adapted to be turned counterclockwise to move the roller cam arrangement 30 counterclockwise to open a door. First, by arranging the rotational connection member 26 in an opposite way such that the roller cam arrangement 30 points in the opposite direction, the roller cam arrangement 30 may be able to lock to a door in the opposite direction. Secondly, by mounting the first housing 110 and the second housing 120 in an opposite way, by turning them 180 degrees, the first and second handles 10, 40 may unlock the arrangement 1 by turning the handles clockwise instead of counterclockwise. Referring to FIGS. 2*a*, 2*b*, the limiter 117 in the first housing 110 would be located to the left instead of to the right when the first housing 110 is mounted in the opposite way. This provides a limiting function preventing the first handle 10 to be turned counterclockwise.

In an alternative embodiment, roller cam arrangement 30 may be located at the second housing 120, replacing the second handle 40. The roller cam arrangement 30 may be coupled to a multi-lock arrangement (not shown) providing multiple locking points on a door to which the handle and lock arrangement 1 may be arranged.

Figure 3:
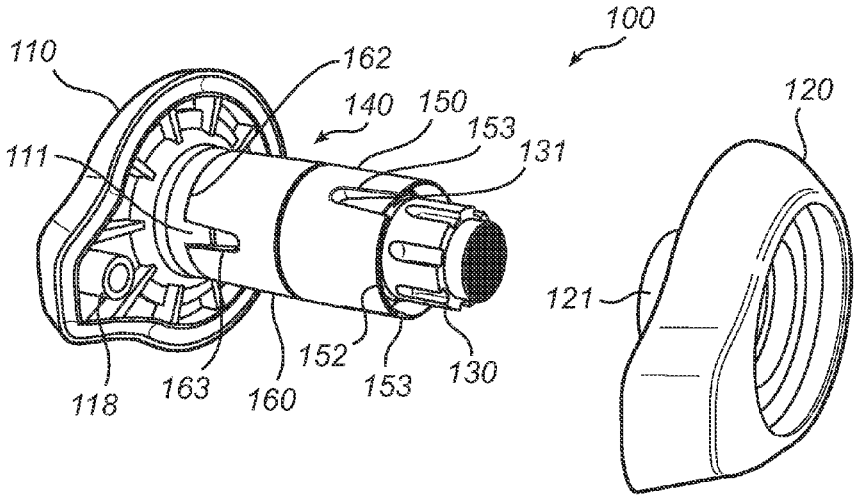
FIG. 3 shows a perspective view of a handle assembly according to an embodiment of the invention.

FIG. 3 illustrates the handle assembly 100 comprising the first housing 110, the second housing 120, the shaft 130 and the distance tube 140. The first tube part 150 of the distance tube 140 comprises at least two slits 153. The slits 153 extends from a second longitudinal end 152 of the first tube part 150, and enables the second longitudinal end 152 to extend radially. In a similar way is a second longitudinal end 162 of the second tube part 160 provided with at least two slits 163. The first housing 110 is provided with an index pin 118 that is adapted to integrate with an opening in the door (not shown). The index pin 118 thereby prevents the first housing 110 from rotating relative to the door. This further provides that the first handle 10 and the parts in the recess 116 may rotate relative to the first housing 110.

Figure 4:
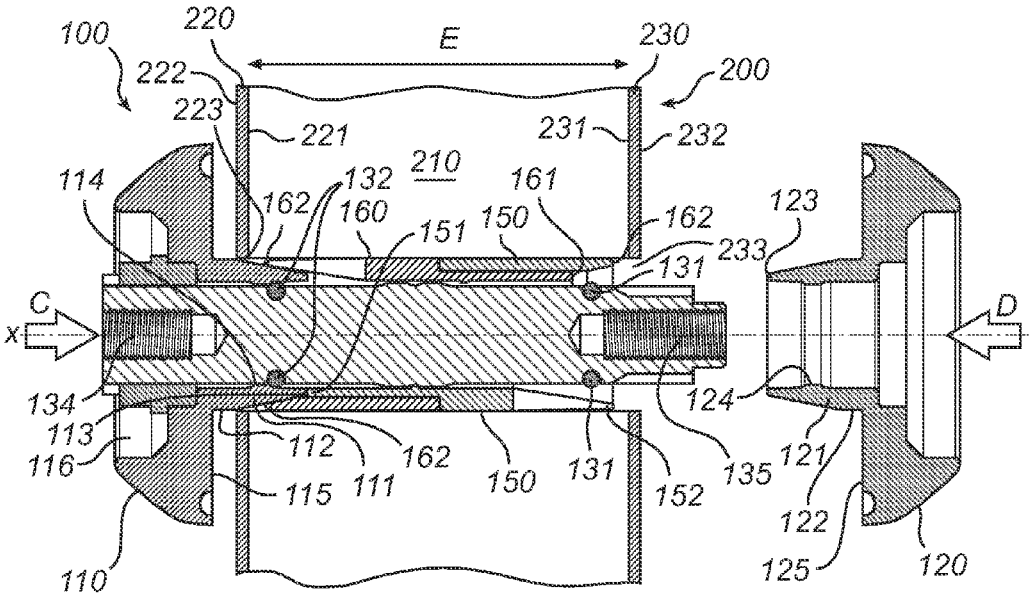
FIG. 4 shows cross-sectional side view of a handle assembly according to an embodiment of the invention.

FIG. 4 illustrates a first step of arranging a handle assembly 100 according to the invention to a door 200. The door 200 comprises a first and a second door wall 220, 230 with a distance E between each other. The distance E creates a space 210 between the door walls 220, 230 that can be empty or filled with any material, such as an insulating material. To the handle assembly 100, the other parts of the handle and lock arrangement 1 may be mounted.

The first housing 110 is together with the shaft 130 and the distance tube 140 arranged to the door 200 by being moved in a direction C through an opening 223 in the first door wall 220. The shaft 130 will further extend through an opening 233 in the second door wall 230. The shaft 130 has a cross-sectional area that is substantially smaller than the cross-sectional area of each of the openings 223, 233 in the door walls 220, 230. The shaft 130 extends through the distance tube 140. The distance tube 140 has a cross-sectional area that is substantially the same as the cross-sectional area of the opening 223 in the first door wall 220, or at least not larger than it may be moved through the opening 223. A back surface 115 of the first housing 110 will abut an outer side 222 of the first door wall 220. The first housing 110 comprises a protruding part 111 adapted to extend through the opening 223 in the first door wall 220. The second housing 120 is arranged to the door 200 by being moved in a direction D such that it receives the shaft 130. A back surface 125 of the second housing 120 will abut an outer side 232 of the second door wall 230. The second housing 120 comprises a protruding part 121 adapted to extend through the opening 233 in the second door wall 230.

Figure 5:
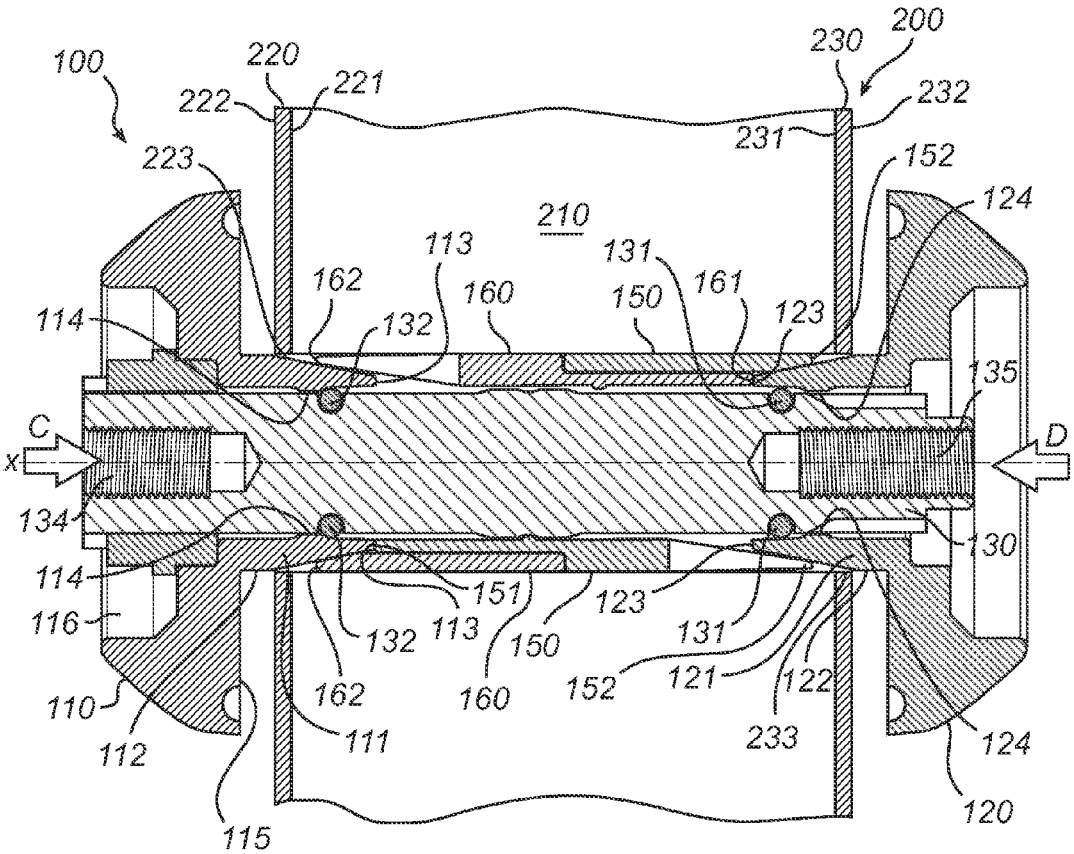
FIG. 5 shows cross-sectional side view of a handle assembly according to an embodiment of the invention.

As further illustrated in FIG. 5, when the protruding parts 111, 121 of the first and the second housing 110, 120 extends through the openings 223, 233 of the door walls 220, 230, the protruding portions 111, 121 will come into contact with the first and the second tube part 150, 160. An end portion 113 of the first protruding part 111 will be in contact with a first longitudinal end 151 of the first tube part 150. An end portion 123 of the second protruding part will be in contact with a first longitudinal end 161 of the second tube part 160.

The first protruding part 111 has a base portion 112 at a portion of the protruding part 111 that is closest to the back surface 115 of the first housing 110. The base portion 112 has a cross-sectional area that is substantially the same as the cross-sectional area of the opening 223 in the first door wall 220. The cross-sectional area of the first protruding part 111 decreases in a direction towards the end portion 113. The first protruding part 111 tapers along the direction C, from the base portion 112 towards the end portion 113. The second protruding part 121 has a base portion 122 at a portion of the protruding part 121 that is closest to the back surface 125 of the second housing 120. The base portion 122 has a cross-sectional area that is substantially the same as the cross-sectional area of the opening 233 in the second door wall 230. The cross-sectional area of the second protruding part 121 decreases in a direction towards the end portion 123. The second protruding part 121 tapers along the direction D, from the base portion 122 towards the end portion 123.

When the end portions 113, 123 of the protruding parts 111, 121 are in contact with the first longitudinal ends 151, 161 of the first and second tube parts 150, 160 respectively, the second longitudinal ends 152, 162 of each tube part 150, 160 will surround respective opposite protruding part 111, 121. I.e. the second end 152 of the first tube part 150 will at least partly surround the second protruding part 121, and the second end 162 of the second tube part 160 will at least partly surround the first protruding part 111. Thereby, the second end 152 of the first tube part 150 will be guided by the second protruding part 121, and the second end 162 of the second tube part 160 will be guided by the first protruding part 111. Due to the slits 153 at the second end 152 of the first tube part 150, the second end 152 is flexible in a radial direction such that the second end 152 can expand along with the increasing cross-sectional area of the second protruding part 121. The slits 163 provides a similar function for the second end 162, such that it is flexible in a radial direction and may expand along with the increasing cross-sectional area of the first protruding member 111.

Figure 6:
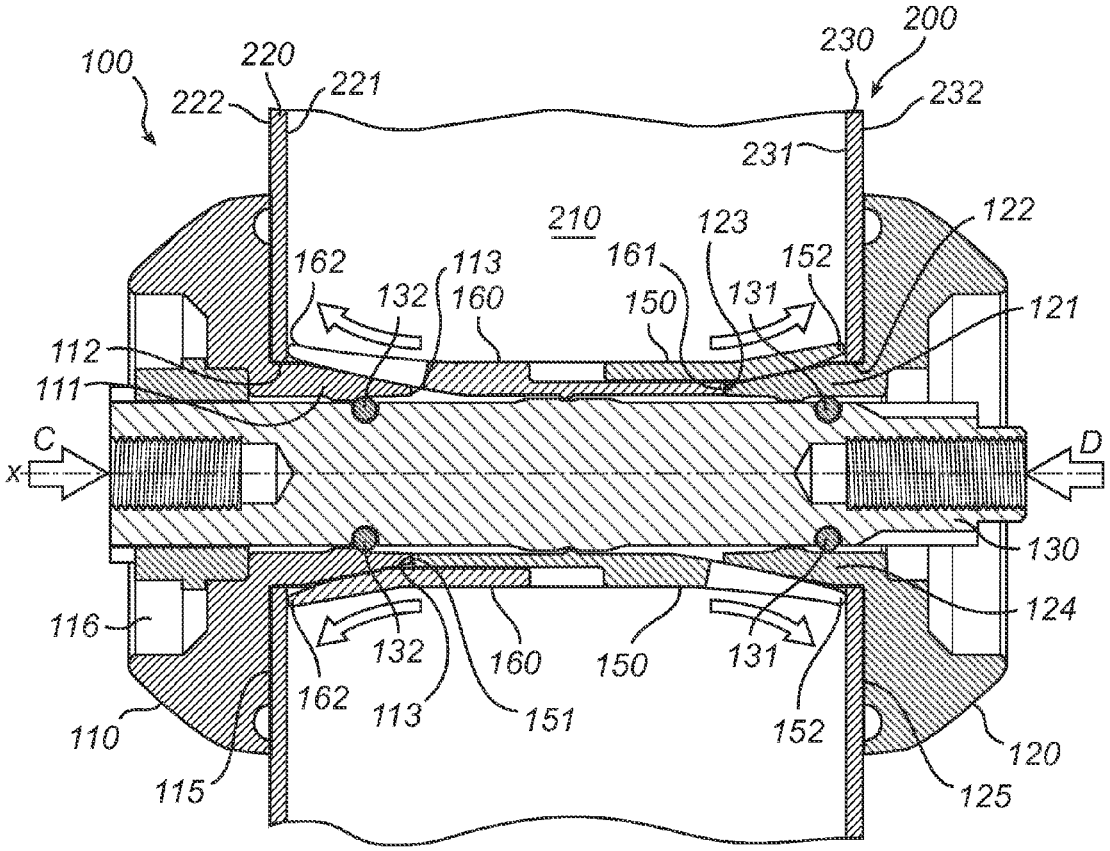
FIG. 6 shows cross-sectional side view of a handle assembly according to an embodiment of the invention.

FIG. 6 illustrates a final step in arranging the handle assembly 100 on the door 200. When the first housing 110 is moved towards the first door wall 220 until the back surface 115 abuts the outer side 222 of the door wall 220, the first tube part 150 is pressed towards the second door wall 230. The second end 152 of the first tube part 150 is thereby expanded radially by the second protruding part 121 until it abuts an inner side 231 of the second door wall 230. Since the base portion 122 of the second protruding part 121 substantially fills the entire opening 233 in the second door wall 230, there is no possibility for the second end 152 to reach the opening 233. The second protruding part 121 forces the second end 152 of the first tube part 150 towards the inner side 231 of the second door wall 230.

In a similar way, when the second housing 120 is moved towards the second door wall 230 until the back surface 125 abuts the outer side 232 of the door wall 230, the second tube part 160 is pressed towards the first door wall 220. The second end 162 of the second tube part 160 is thereby expanded radially by the first protruding part 111 until it abuts an inner side 221 of the first door wall 220. Since the base portion 112 of the first protruding part 111 substantially fills the entire opening 223 in the first door wall 220, there is no possibility for the second end 162 of the second tube part 160 to reach the opening 223. The first protruding part 111 forces the second end 162 of the second tube part towards the inner side 221 of the first door wall 220.

The first housing 110 and the second housing 120 is prevented from axial movement relative to the shaft 130 by means of the inner threads 134, 135 in each end of the shaft. The housings 110, 120 is axially clamped to the shaft 130 if a screw is engaged with the threads 134, 135 that presses the housings 110, 120 towards the shaft 130. Thereby, the housings 110, 120 are held in the assembled position as shown in FIG. 6. In this position, it is impossible to deform the door 200 by pressing the two door walls 220, 230 towards each other. This is impossible due to the tube parts 150, 160 being pressed to the inner sides 221, 231 of the door walls 220, 230. At the same time as the tube parts 150, 160 presses on the inner sides 221, 231, the housings 110, 120 presses on the outer sides 222, 232 of the door walls 220, 230. The harder the housings 110, 120 press on the outer sides 222, 232 of the door walls 220, 230, the harder the tube parts 150, 160 will press on the inner sides 221, 231 of the door walls 220, 230.

As seen in FIG. 3-6, the shaft 130 is provided with two rubber rings 131, 132. The rubber rings 131, 132 has a slightly larger cross-sectional area that the rest of the shaft 130. The rubber rings 131, 132 provide a raising on the outer surface of the shaft 130. The first and second protruding members 111, 121 each have a tubular shape, providing an inner surface. The tubular shape of the protruding members 111, 121 is provided to receive the shaft 130. On the inner surfaces, each protruding member 111, 121 have a shoulder 114, 124, raising from the rest of the inner surfaces. The shoulders 114, 124 and the rubber rings 131, 132 together form two snap catches. When the second housing 120 is moved in the direction D, onto the shaft, the shoulder 124 will reach contact with the rubber ring 131. By providing some extra force in the direction D, the user will force the protruding member 121 such that the shoulder 124 passes the rubber ring 131. Thereby, extra force is also needed to remove the protruding member 121 and the second housing 120 from the shaft 130. The snap catch formed by the rubber ring 132 and the shoulder 114 on the first protruding member 111 functions in a similar way.

In the drawings and specification, there have been disclosed preferred embodiments and examples of the invention and, although specific terms are employed, they are used in a generic and descriptive sense only and not for the purpose of limitation, the scope of the invention being set forth in the following claims.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. Handle assembly for arrangement on a double-walled door comprising a first door wall and a second door wall, and a space between the two door walls, the handle assembly comprising;

a shaft, having a first and a second end, and arranged for extending through the two door walls, a first handle part for arrangement to the first end of the shaft such that the first handle part abuts an outer side of the first door wall, a second handle part for arrangement to the second end of the shaft such that the second handle part abuts an outer side of the second door wall, and a distance tube through which the shaft extends, the distance tube comprising a first tube part and a second tube part, wherein the first handle part, when arranged to the shaft such that the first handle part abuts an outer side of the first door wall, contacts the first tube part such that the first tube part is pressed towards an inner side of the second door wall, and wherein the second handle part, when arranged to the shaft such that the second handle part abuts an outer side of the second door wall, contacts the second tube part such that the second tube part is pressed towards an inner side of the first door wall, and further wherein the first handle part comprises a first protruding member adapted to extend through the first door wall, and wherein the first protruding member is adapted to contact a first longitudinal end portion of the first tube part such that a second longitudinal end portion, opposite the first longitudinal end portion, of the first tube part is pressed against the inner side of the second door wall, and wherein the second handle part comprises a second protruding member adapted to extend through the second door wall, and wherein the second protruding member is adapted to contact a first longitudinal end portion of the second tube part such that a second longitudinal end portion, opposite the first longitudinal end portion, of the second tube part is pressed against the inner side of the first door wall, wherein the second longitudinal end portion of the first tube part is adapted to at least partly surround the second protruding member when the handle assembly is arranged on the shaft, such that the second longitudinal end portion of the first tube part is adapted to radially expand along with the increasing cross-section of the second protruding member when being pressed against the inner side of the second door wall, and wherein the second longitudinal end portion of the second tube part is adapted to at least partly surround the first protruding member when the handle assembly is arranged on the shaft, such that the second longitudinal end portion of the second tube part is adapted to radially expand along with the increasing cross-section of the first protruding member when being pressed against the inner side of the first door wall.

2. Handle assembly according to claim 1, wherein the first protruding member is adapted to extend through an opening in the first door wall, and the second protruding member is adapted to extend through an opening in the second door wall, wherein each of the first and the second protruding member is adapted to, at a base portion of each protruding member closest to respective handle part, have a cross-section of substantially the same size as the respective opening in each door wall through which each protruding part is adapted to extend, and wherein the cross-section of each protruding member tapers from said base portion towards an end portion, wherein said end portion of each protruding member is adapted to press on the first and second tube parts respectively.

3. Handle assembly according to claim 1, wherein the second longitudinal end portion of the first tube part is provided with at least one slit.

4. Handle assembly according to claim 1, wherein the second longitudinal end portion of the second tube part is provided with at least one slit.

5. Handle assembly according to claim 1, wherein the cross-section of the distance tube is adapted to be of substantially the same size as each of openings in the first and second door walls through which openings the shaft is adapted to extend.

6. Handle assembly according to claim 1, wherein the first tube part and the second tube part overlap each other and together form the substantially hollow distance tube adapted to receive said shaft adapted to extend through the distance tube.

7. Handle assembly according to claim 1, wherein the handle assembly is provided with a locking means adapted to lock the shaft to at least one handle part when the at least one handle part is pressed towards a door wall.

8. Handle assembly according to claim 7, wherein the locking means comprises a projection provided on the shaft and a shoulder provided on the at least one handle part adapted to integrate with said projection to lock the handle part to the shaft.

9. Handle assembly according to claim 8, wherein said projection on the shaft comprises a rubber ring mounted on the shaft.

10. Handle assembly according to claim 8, wherein said shoulder is located on at least one of the first and the second protruding members.

11. Handle assembly according to claim 10, wherein the protruding members are substantially tubular, and said shoulder is located on an inner surface of at least one of the protruding members.

12. Method for assembling a handle assembly to a double-walled door comprising a first door wall and a second door wall, and a space between the two door walls, the method comprising the steps of:

arranging a first handle part to a first end of a shaft, arranging a distance tube to said shaft such that the shaft extends through said distance tube, wherein the distance tube comprises a first tube part and a second tube part, arranging said shaft such that it extends through the two door walls, arranging a second handle part to a second end of the shaft, pressing the first handle part against the first door wall such that the first tube part is pressed against an inner side of the second door wall, and pressing the second handle part against the second door wall such that the second tube part is pressed against an inner side of the first door wall.

13. Method according to claim 12, wherein the method further comprises the steps of locking the first handle part in a position abutting the first door wall, and locking the second handle part in a position abutting the second door wall.

14. A double-walled door having a first door wall and a second door wall, and a space between the two door walls, the door further comprising a handle assembly, comprising;

a shaft, having a first and a second end, and arranged for extending through the two door walls, a first handle part for arrangement to the first end of the shaft such that the first handle part abuts an outer side of the first door wall, a second handle part for arrangement to the second end of the shaft such that the second handle part abuts an outer side of the second door wall, and a distance tube through which the shaft extends, the distance tube comprising a first tube part and a second tube part, wherein the first handle part, when arranged to the shaft such that the first handle part abuts an outer side of the first door wall, contacts the first tube part such that the first tube part is pressed against an inner side of the second door wall, and wherein the second handle part, when arranged to the shaft such that the second handle part abuts an outer side of the second door wall, contacts the second tube part such that the second tube part is pressed against an inner side of the first door wall.

15. Double-walled door according to claim 14, wherein the first handle part comprises a first protruding member adapted to extend through the first door wall, and wherein the first protruding member is adapted to contact a first longitudinal end portion of the first tube part such that a second longitudinal end portion, opposite the first longitudinal end portion, of the first tube part is pressed against the inner side of the second door wall.

16. Double-walled door according to claim 15, wherein the second handle part comprises a second protruding member adapted to extend through the second door wall, and wherein the second protruding member is adapted to contact a first longitudinal end portion of the second tube part such that a second longitudinal end portion, opposite the first longitudinal end portion, of the second tube part is pressed against the inner side of the first door wall.

17. Double-walled door according to claim 14, wherein the first handle part comprises a first protruding member adapted to extend through an opening in the first door wall, and the second handle part comprises a second protruding member adapted to extend through an opening in the second door wall, wherein each of the first and the second protruding member is adapted to, at a base portion of each protruding member closest to respective handle part, have a cross-section of substantially the same size as the respective opening in each door wall through which each protruding part is adapted to extend, and wherein the cross-section of each protruding member tapers from said base portion towards an end portion, wherein said end portion of each protruding member is adapted to press on the first and second tube parts respectively.

18. Double-walled door according to claim 15, wherein the second longitudinal end portion of the first tube part is provided with at least one slit.

19. Double-walled door according to claim 16, wherein the second longitudinal end portion of the second tube part is provided with at least one slit.

20. Double-walled door according to claim 16, wherein the second longitudinal end portion of the first tube part is adapted to at least partly surround the second protruding member when the handle assembly is arranged on the shaft, such that the second longitudinal end portion of the first tube part is adapted to radially expand along with the increasing cross-section of the second protruding member when being pressed against the inner side of the second door wall, and wherein the second longitudinal end portion of the second tube part is adapted to at least partly surround the first protruding member when the handle assembly is arranged on the shaft, such that the second longitudinal end portion of the second tube part is adapted to radially expand along with the increasing cross-section of the first protruding member when being pressed against the inner side of the first door wall.

* * * * *